US010119754B2

(12) United States Patent
Butler

(10) Patent No.: US 10,119,754 B2
(45) Date of Patent: Nov. 6, 2018

(54) MARINE DRINK COOLER

(71) Applicant: Adam Butler, Moose Jaw (CA)

(72) Inventor: Adam Butler, Moose Jaw (CA)

( * ) Notice: Subject to any disclaimer, the term of this patent is extended or adjusted under 35 U.S.C. 154(b) by 0 days.

(21) Appl. No.: 15/278,193

(22) Filed: Sep. 28, 2016

(65) Prior Publication Data

US 2017/0343278 A1 Nov. 30, 2017

(30) Foreign Application Priority Data

May 31, 2016 (CA) ..... 2931733

(51) Int. Cl.

| | |
|---|---|
| ***A46B 11/00*** | (2006.01) |
| ***A61C 19/06*** | (2006.01) |
| ***F25D 31/00*** | (2006.01) |
| ***A47G 23/02*** | (2006.01) |
| ***F25D 1/02*** | (2006.01) |
| ***F25D 23/10*** | (2006.01) |

(52) U.S. Cl.

CPC ..... *F25D 31/006* (2013.01); *A47G 23/0208* (2013.01); *F25D 1/02* (2013.01); *F25D 23/10* (2013.01); *A47G 2023/0275* (2013.01); *A47G 2200/02* (2013.01)

(58) Field of Classification Search

CPC ..... F25D 31/006; F25D 1/02; F25D 23/10; A47G 23/0208; A47G 2023/0275; A47G 2200/02

USPC ..... 221/279

See application file for complete search history.

(56) References Cited

U.S. PATENT DOCUMENTS

| | | | | | |
|---|---|---|---|---|---|
| 1,486,390 | A * | 3/1924 | Pedersen | A01K 69/06 | 43/105 |
| 2,799,146 | A * | 7/1957 | Meagher | A01K 97/01 | 249/66.1 |
| 2,877,595 | A * | 3/1959 | Steuart | A01K 97/01 | 249/175 |
| 3,263,806 | A | 8/1966 | Ring | | |
| 3,555,827 | A | 1/1971 | Herr | | |
| 3,625,397 | A * | 12/1971 | Shelly | A47F 1/06 | 221/155 |
| 3,948,417 | A * | 4/1976 | McCain | A45D 6/00 | 132/212 |

(Continued)

FOREIGN PATENT DOCUMENTS

| | | |
|---|---|---|
| CA | 1151013 | 2/1983 |
| JP | 3200834 U | 10/2015 |

*Primary Examiner* — Rakesh Kumar

(74) *Attorney, Agent, or Firm* — Kimberly O Snead

(57) ABSTRACT

A portable beverage carrier and dispenser. The carrier comprises an elongate tube have one end open and the opposite end generally enclosed. The tube includes perforations to permit water to move in and out of the tube, and a float that is placed into the tube prior to inserting beverage containers. The carrier is designed to be inserted into a hole in the ice surface on a body of water. A flange prevents the tube from falling into the hole into the underlying body of water. Anchors can be provided to anchor the carrier to the ice surface. When the carrier is placed in a hole in the ice surface, water enters the interior of the tube via the perforations. The float is placed in the tube and then beverage containers are loaded on top of the float. The buoyancy of the float in the water forces the beverage containers upwards in the tube so that the topmost container can be readily retrieved by a user.

2 Claims, 1 Drawing Sheet

(56) References Cited

U.S. PATENT DOCUMENTS

| | | | | |
|---|---|---|---|---|
| 4,638,645 | A * | 1/1987 | Simila | F25D 3/08 62/371 |
| 4,910,977 | A * | 3/1990 | Hilton | A45C 11/20 220/592.1 |
| 6,519,893 | B2 | 2/2003 | Shook | |
| 7,100,397 | B1 | 9/2006 | Grattean | |
| 8,943,735 | B2 * | 2/2015 | Brown | A01K 97/01 43/4.5 |
| 2005/0087538 | A1 | 4/2005 | Wolfe et al. | |
| 2005/0252234 | A1 * | 11/2005 | Kim | F25D 3/08 62/457.4 |
| 2010/0193660 | A1 | 8/2010 | Colla et al. | |
| 2011/0042549 | A1 * | 2/2011 | Schiro | F25D 3/08 249/134 |
| 2015/0082686 | A1 | 3/2015 | Merritt | |

* cited by examiner

MARINE DRINK COOLER

BACKGROUND

A variety of devices have been developed for carrying and dispensing beverage containers. For example U.S. Pat. No. 3,263,806 (Ring) discloses a tubular beverage container storage system. Beverage containers are inserted into the tube and a spring system creates a force that pushes the containers upwards for retrieval by a user. U.S. Pat. No. 7,100,397 (Gratteau) discloses another tubular style beverage container that can be secured to a golf bag. Retrieval of beverage containers is accomplished by means of a line that runs under the containers, and thus when pulled shortens to produce a lifting force to move containers upwards in the tube Depending on where the beverages are to be stored and consumed can create unique challenges for prior art beverage container systems. For example, when beverages are stored in an outdoor environment at temperatures below freezing, there is a significant risk of the contents of the beverage container freezing. When water-based liquids freeze they expand in volume. This in turn can generate enough force to rupture the container.

These types of conditions can exist when people are engaged in past times such as ice-fishing. During ice fishing it is often necessary to spend extended periods of time outdoors while monitoring fishing lines. As such people engaged in the activity will typically supply themselves with food an beverage, since typically the activity is conducted at isolated locations where such amenities may not be available. A problem further arises in that it is effectively impossible to keep beverages from freezing.

Thus, what is needed is an effective carrier and storage system for beverage containers, and one that when in use prevents the contents of a beverage container from freezing.

BRIEF SUMMARY

A preferred embodiment of the present invention comprises a tube, one end of which is substantially closed, and the opposite end that is open, or at least with a moveable cover, and perforations in the body of the tube. The closed end is designed to be lowered into a hole in the ice so that frigid water enters the interior of the tube. A flange at the opposite end is designed to engage the surface of the ice in order to maintain the tube in place within the hole in the ice.

Within the interior of the tube is placed a float. The float is sized so that is able to move freely up and down within the interior of the tube over substantially the entire length of the tube. When in use, beverage containers are inserted into the tube, on top of the float. The weight of the full beverage container counteracts the buoyant force acting on the float by the water that enters the tube when the device is in use. Thus, addition of each beverage container forces the float downwards in the tune until the float contacts the closed end of the tube. Removing a beverage container results in less weight acting on the float, and thus the buoyant force acting on the float lifts the remaining beverage containers upwards within the tube so that the next container is readily recoverable from the tube by a user.

The apparatus may also include a flange positioned towards the open end of the tube. The flange is designed such that it can engage a region around the hole into which the tube is placed when in use. For example, the flange may comprise engaging structures that allow for insertion into the ice around the hole such that the tube is anchored in place.

Anchoring the tube prevents it from falling into the hole into which it is placed, or from coming out of the hole.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Description

In the sport of ice-fishing, it is typical to spend extended lengths of time on the frozen surface of a lake while monitoring fishing gear for a catch. As a result, adherents to the sport often assemble portable shelters to reduce exposure to the elements. These shelters can be stocked with food and beverages intended for consumption by the occupants of the shelter. One challenge with liquid refreshments, is because of the surrounding air temperature, there is an increased risk of freezing of liquids. In enclosed containers, the force created within the container by water as it expands during freezing can be sufficient to rupture the container.

It is well-known that because ice is less dense than water, than on frozen bodies of water, under the ice the water remains liquid, with a temperature at or about 4° C. The present invention takes advantage of this property of water and provides a holder for beverage containers that allows for easy retrieval of a beverage, and at the same time, prevents the contents of the beverage container from freezing.

Figure 1:
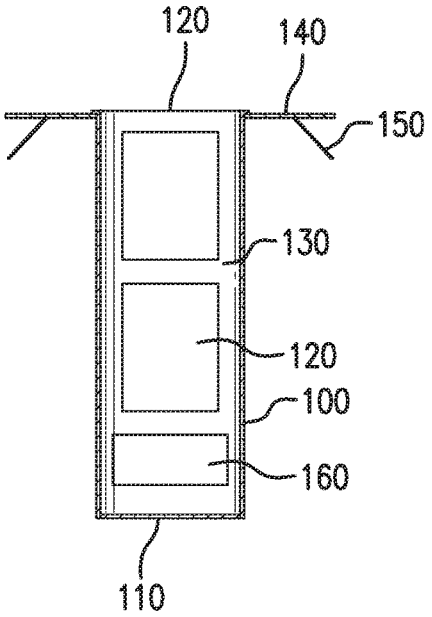
FIG. 1 illustrates an cross sectional view of an embodiment of a beverage carrier and dispenser in accordance with the present disclosure.

As shown in FIG. 1, in one embodiment, the invention comprises a tube 100 that is sized such that the interior of the tube has a diameter large enough such that one or more beverage containers 170 can be easily inserted lengthwise into the tube. Preferably, the inner dimensions of the tube are sized so that the container(s) can slide freely along the length of the tube. One end of the tube will further comprise an opening 120 sized to admit the introduction of one or more beverage containers into the interior of the tube 130. This end of the tube will also preferably include a flange 140, the flange designed to prevent the tube from falling down into the hole and being lost. In addition, the flange may also include one or more anchors 150, the anchors designed to engage the surface of the ice so that the entire assembly remains in a relatively fixed position when in use.

Figure 2:
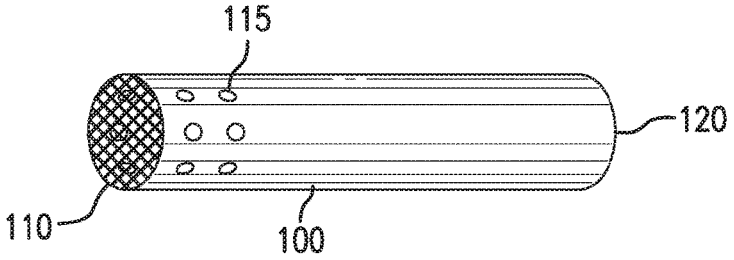
FIG. 2 illustrates an perspective view of an embodiment of a beverage carrier and dispenser in accordance with the present disclosure.

The opposite end 110 will generally be enclosed, to prevent containers from being inadvertently lost out the end of the tube opposite from the end of the tube they were loaded into. As shown in FIG. 2, the tube can further comprise one or more perforations 115, the perforations functioning to allow water to enter the interior of the tube, when the container apparatus is in use, as is described below.

The present invention also further comprises a float 160, the float configured to fit within the interior of the tube, and like a beverage container, able to slide freely substantially along the length of the container. The float can be comprised of a number of materials, and have a number of configurations. For example, the float may be constructed from a naturally buoyant material, with a density less than that of water. Alternatively, the float may comprise a hollow structure that encloses a volume of air or other gas. Those of skill in the art will readily recognize the various types of floats and their manner of construction that would be suitable for use in embodiments of the present invention.

When in use, the tube is intended to be inserted into a hole formed in the ice. The tube is inserted enclosed end first. As it is inserted into the hole, water in the hole in the ice will enter the interior of the tube through the perforations. The tube will be lowered into the hole until such point as the flange contacts the surface of the ice surrounding the hole, the flange preventing the tube from falling into the hole.

To use the beverage container, a user will first insert the float into the interior of the tube. Then, beverage containers will be stacked one by one on top of the float. The weight of each beverage container will push the float downwards in the tube towards the enclosed end. Conveniently, the perforations will allow for water to be pushed out of the interior of the tube as the float and beverage containers are loaded. The float can be designed such that it provides just enough buoyant force so as to lift a beverage container so that the top of the beverage container is just at the top of the tube when the tube is in position within a hole in the ice. Since beverage containers are typically filled with a water-based beverage, they will only have a slight negative buoyancy when immersed in the water within the tube. Thus, the float will be readily able to force a stack upwards in the tube such that the top of a container is readily retrievable by a user.

Figure 3:
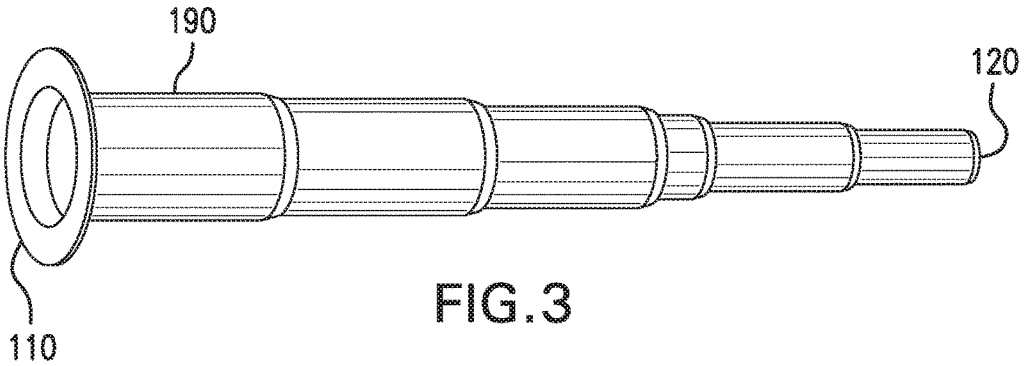
FIG. 3 illustrates embodiment of a beverage carrier and dispenser wherein the elongate tube comprises telescoping segments.

In some cases, it will also be possible to provide a tube that is able to telescope, as depicted in FIG. 3. This will provide two advantages. First, the tube will be extendable over a range of desired lengths allowing for a range of numbers of beverage containers to be placed in the tube when in use. Second, telescoping permits the tube to be collapsed down to a shorter size when not in use, making storage more convenient.

The present invention has been described herein with regard to preferred embodiments. However, it will be obvious to persons skilled in the art that a number of variations and modifications can be made without departing from the scope of the invention as described herein.

What is claimed is:

1. A beverage dispensing carrier, the carrier comprising:

an elongate, telescoping tube having multiple length portions, each of the multiple length portions having a beveled bottom connecting portion, an enclosed end and an open end, an interior, and an exterior, and an internal cross-section of a shape and size configured to admit one or more beverage containers;

wherein the open end further comprises a flange, the flange operative to maintain the tube in a desired position within a hole in an ice surface of a body of water;

the tube further comprising at least one perforation, the at least one perforation operative to permit the passage of water in and out of the tube, when the tube is positioned within the hole;

a float, the float sized such that it will move substantially freely back and forth within the interior of the tube, movement of the float being the result of the net force resulting from the buoyancy of the float and the weight of one or more beverage containers inserted into the interior of the tube between the float and the open end of the tube; and at least one anchor, the at least one anchor configured to cooperate with the flange to engage the ice surface, such that the carrier is substantially prevented from moving within the hole in the ice surface;

wherein the telescoping tube is extended over a range of lengths and collapsed for storage.

2. The carrier of claim 1, wherein the open end of the carrier further comprises a moveable cover.

* * * * *